US006533122B1

(12) United States Patent
Plunkett

(10) Patent No.: US 6,533,122 B1
(45) Date of Patent: Mar. 18, 2003

(54) SHIPPING CONTAINER

(76) Inventor: James Plunkett, 9 Maritime Dr., Wareham, MA (US) 02571

( * ) Notice: Subject to any disclaimer, the term of this patent is extended or adjusted under 35 U.S.C. 154(b) by 0 days.

(21) Appl. No.: 09/499,128

(22) Filed: Feb. 7, 2000

(51) Int. Cl.[7] ..... B65D 19/00

(52) U.S. Cl. ..... 206/600; 220/4.28; 220/7; 220/826; 217/15; 217/47

(58) Field of Search ..... 206/386, 600; 220/4.29, 4.31, 4.32, 4.33, 6, 7, 252, 255, 810, 826, 831, 845, 324, 327, 495.03, 495.05, 495.06, 661, 4.16, 4.17, 4.12, 4.13, 1.5, 1.6, 819, 822, 824; 108/55.1, 55.3, 56.1, 56.3

(56) References Cited

U.S. PATENT DOCUMENTS

| | | | | | |
|---|---|---|---|---|---|
| 875,780 | A | * | 1/1908 | Coats | 217/47 |
| 931,808 | A | * | 8/1909 | Smith | 217/47 |
| 1,120,058 | A | * | 12/1914 | Hutto | 217/47 |
| 1,132,000 | A | * | 3/1915 | Dight | 217/15 |
| 1,135,866 | A | * | 4/1915 | Turner | 217/47 |
| 2,720,998 | A | | 10/1955 | Potter | |
| 3,836,217 | A | * | 9/1974 | Shiina | 312/107.5 |
| 3,853,238 | A | * | 12/1974 | Luisada et al. | 220/4.28 |
| 3,989,157 | A | * | 11/1976 | Veenema | 220/4.17 |
| 4,177,907 | A | | 12/1979 | Funaioli et al. | |
| 4,482,074 | A | * | 11/1984 | Lalley | 220/6 |
| 4,676,373 | A | | 6/1987 | Schneider | |
| 4,715,508 | A | | 12/1987 | Schurch | |
| 4,804,113 | A | * | 2/1989 | Ciaccio | 220/254 |
| 4,917,255 | A | | 4/1990 | Foy | |
| 5,002,194 | A | | 3/1991 | Nichols | |
| 5,029,734 | A | | 7/1991 | Nichols | |
| 5,056,667 | A | | 10/1991 | Coogan | |
| 5,156,291 | A | * | 10/1992 | Mielke | 220/254 |
| 5,253,763 | A | * | 10/1993 | Kirkley et al. | 206/600 |
| 5,269,414 | A | | 12/1993 | D'Hollander | |
| 5,330,069 | A | * | 7/1994 | Jamison et al. | 220/826 |
| 5,492,270 | A | | 2/1996 | Avery et al. | |
| 5,588,549 | A | * | 12/1996 | Furtner | 220/7 |
| 5,660,299 | A | * | 8/1997 | Harvey | 220/524 |
| 5,711,444 | A | * | 1/1998 | Meacham et al. | 220/6 |

FOREIGN PATENT DOCUMENTS

| | | |
|---|---|---|
| CA | 1159379 | 12/1983 |
| DE | 1486433 | 4/1969 |
| DE | 060598 | 11/1989 |
| FR | 1331060 | 5/1963 |
| GB | 2245883 | 1/1992 |
| WO | 8911422 | 11/1989 |

OTHER PUBLICATIONS

Advertisement, "Designed with Food in Mind," "The Uni–Fold Food Grade Intermediate Bulk Container," LB Systemer a/s Uni–Fold, Nordgarde 1A–4520 Svinninge Denmark, 5 pages.

Advertisement, "TNT Container Logistics, Hazacon & Uni–Fold," "Containers for Hazardous Goods," 2 pages.

(List continued on next page.)

*Primary Examiner*—Shian Luong
(74) *Attorney, Agent, or Firm*—Dorsey & Whitney LLP

(57) ABSTRACT

The present invention provides a foldable shipping container that provides users with access to the liner fill port in confined areas and that can be used to transport liquids, powders, or solids. One embodiment of the shipping container has a generally rectangular base pivotally connected a first side wall and a second side wall, a first lid section pivotally connected to the first side wall, a second lid section pivotally connected to the second side wall, and a third lid section pivotally connected to the first lid section. The third lid section provides access to a centrally located liner fill port.

16 Claims, 10 Drawing Sheets

OTHER PUBLICATIONS

Advertisement, "Stocklin, Collapsible Container," "Innovative and Environment–Friendly Packaging," Walter Stocklin AG, Forder Und Lagertechnik, CH–4143 Dornach/Schweiz, 4 pages.

Advertisement, "CFS Developments (Proprietary) Ltd," Postal Address: P.O. Box 4852 Luipaardsvlei 1743 South Africa, 4 pages.

Advertisement, "Reusable Container Systems," "Industry leader in quality, innovation and service", Ropak Corporation, Materials Handling Group, A Member of the Linpac Group of Companies, 7 pages.

Advertisement, "ECONOBOX, A Whole New Dimension," "Cost–effective Solutions for Materials Handling," GE Polymer Logistics, 3 pages.

Advertisement, "Introducing the Arena 330 Shipper," "It beats the drum and everything else," GE Silicones, A. R. Arena Products, Inc., 2101 Mt. Read Blvd., Rochester, New York 14615, 4 pages.

* cited by examiner

SEE FIG. 7
SEE FIG. 8
52
40
10
12
14
16
18
19
21a
21b
21c
21d
22
23
24
30
32
36
38
40
41
42
43
44
45
46a
46b
46c
46e
46g
46h
50a
50b
54
56
58
70
72

SHIPPING CONTAINER

BACKGROUND OF THE INVENTION

1. Field of the Invention

The present invention generally relates to reusable transport containers. More particularly, the present invention relates to a foldable container having a three-panel lid that is suitable for the transport, storage and handling of liquid materials and of free-flowing powder materials.

2. Description of the Prior Art

Rigid shipping containers are frequently used to ship and to handle liquids and other free flowing materials, such as powders, pellets, etc. One frequently used rigid shipping container is a 55-gallon steel drum. There are, however, many problems associated with steel drums. For example, steel drums are difficult to handle when filled, are susceptible to rust, are costly to recycle, and are difficult to open and close. In addition, the cylindrical shape of the drums makes them inherently inefficient to store and to ship in cubic freight containers.

Another frequently used shipping container is an intermediate bulk container ("IBC"). Conventional IBCs generally consist of a rectangular shell having a capacity of from about 50 to 5000 liters and a rigid plastic bottle that contains the material to be transported or stored. The rigid plastic bottle typically has a fill port and a drain valve. The fill port is usually centrally located on the bottle's top surface. The drain valve is usually located near the bottom of the container. These fill port and the drain valve allow users to fill the container, to empty the container, or to sample the contents of the container.

Conventional IBCs are desirable because they are easier to stack than barrels and because they can fit neatly into various transport vehicles. One problem with conventional IBCs, however, is that the empty containers take up the same volume as the full containers. This drawback makes it uneconomical to reuse the IBCs because it costs too much to ship the empty containers back to the supplier. Thus, it is desirable to be able to fold or disassemble the empty containers into a smaller volume for shipping. It is also desirable that the folded or disassembled containers have a flat top surface so that multiple IBCs can be stacked on top of each other.

U.S. Pat. No. 4,177,907 to Funaioli et al. ("Funaioli") and U.S. Pat. No. 5,269,414 to D'Hollander ("D'Hollander") each disclose a foldable shipping container. One problem with both containers, however, is that they fail to provide access to the fill port when the IBC is in a constricted space or when the present filling equipment is set up to fill IBCs through a central port. This is often a major concern for the filler of the container. That is, IBCs are frequently used, transported, and stored in relatively constricted areas. Conventional foldable IBCs like those depicted in Funaioli and D'Hollander require that the user open a large, heavy lid section before they can access the fill port for filling, sampling, or for any other reason. Frequently, however, there is not enough clearance to do so. This drawback frequently forces users to move the IBC to an area that has more space. This procedure can take considerable time, particularly when the user merely wishes to sample the IBC's contents. In addition, the size of the lid section, coupled with the height of the IBC, can make the lids difficult to open.

Accordingly, there is a need for an IBC that can be folded or disassembled into configuration having a relatively small volume and a flat top surface. There is also a need for an IBC that can provide users with easy access to the liner valve when the IBC is in a confined area.

SUMMARY OF THE INVENTION

The present invention provides a foldable intermediate bulk container that gives users access to the liner's fill port in confined areas. One embodiment of the present invention comprises a generally rectangular base; a first side wall and a second side wall, each pivotally connected to the base; a first lid section pivotally connected to the first side wall; a second lid section pivotally connected to the second side wall; and a third lid section pivotally connected to the first lid section. Preferably, the third lid section is positioned in the vicinity of the liner's fill port to provide access thereto and covers less than about one-half of the length of the shipping container. This embodiment may further comprise a third side wall and a fourth side, each of which is also pivotally connected to the base. The side walls in this embodiment pivot between an operative position generally perpendicular to the base and a folded position in which the side walls are generally parallel to the base. The pivot point of each side wall is located at a different distance from the base so that the container will have a top flat surface when in its folded configuration.

Another aspect of the present invention is a method of making a foldable shipping container. One embodiment of this method comprises the acts of pivotally attaching a first side wall and a second side wall to opposite sides of a base, pivotally attaching a first lid panel to the first side wall, pivotally attaching a second lid panel to the second side wall, and pivotally attaching a third lid panel to the first lid panel. This embodiment may further comprise the act of pivotally attaching a third side wall and a fourth side wall to opposite sides of the base.

Yet another aspect of the present invention is a method of collapsing a shipping container having a first lid section pivotally connected to a first side wall, a second lid section pivotally connected to a second side wall, and a third lid section pivotally connected to the first lid section. One embodiment of this method comprises the acts of pivoting the first side wall and the first lid section from a generally vertical configuration to a generally horizontal configuration, whereby an outer surface of the first lid section lies adjacent to an outer surface of the first side wall; and pivoting the second side wall, the second lid section, and the third lid section from a generally vertical configuration to a generally horizontal configuration, whereby an inner surface of the second lid section lies adjacent to an inner surface of the third lid section and whereby an outer surface of the third lid section lies adjacent an inner surface of the first side wall.

Accordingly, it is an object of the invention to provide an inexpensive shipping container that can protect its contents during shipment.

It is also an object of the invention to provide a shipping container that can store liquid and free-flowing powder materials using a bag or liner medium.

It is also an object of the invention to provide a shipping container that can be economically reused.

It is also an object of the invention to provide a shipping container that can be folded or assembled into a configuration having a relatively large volume and into a configuration having a relatively small volume.

It is also an object of the invention to provide a stackable shipping container having a flat top in its erect and collapsed state.

It is also an object of the invention to provide a shipping container that is sized and shaped to fit into standard sized transportation vehicles with minimal wasted space.

It is also an object of the invention to provide a shipping container that is suitable for use with fork lifts and other bulk handling equipment.

It is also an object of the invention to provide a shipping container that users can open in confined spaces.

It is also an object of the invention to provide a shipping container that users can open without having to lift, pivot, or otherwise manipulate a heavy lid.

It is also an object of the invention to provide a shipping container and flexible liner that are compatible with the center-fill equipment typically used with rigid plastic bottles.

These and other objects, features, and advantages will become better understood with reference to the following description, appended claims, and accompanying drawings.

DESCRIPTION OF THE PREFERRED EMBODIMENT

Figures 1, 2, 7A, 7B, 8:
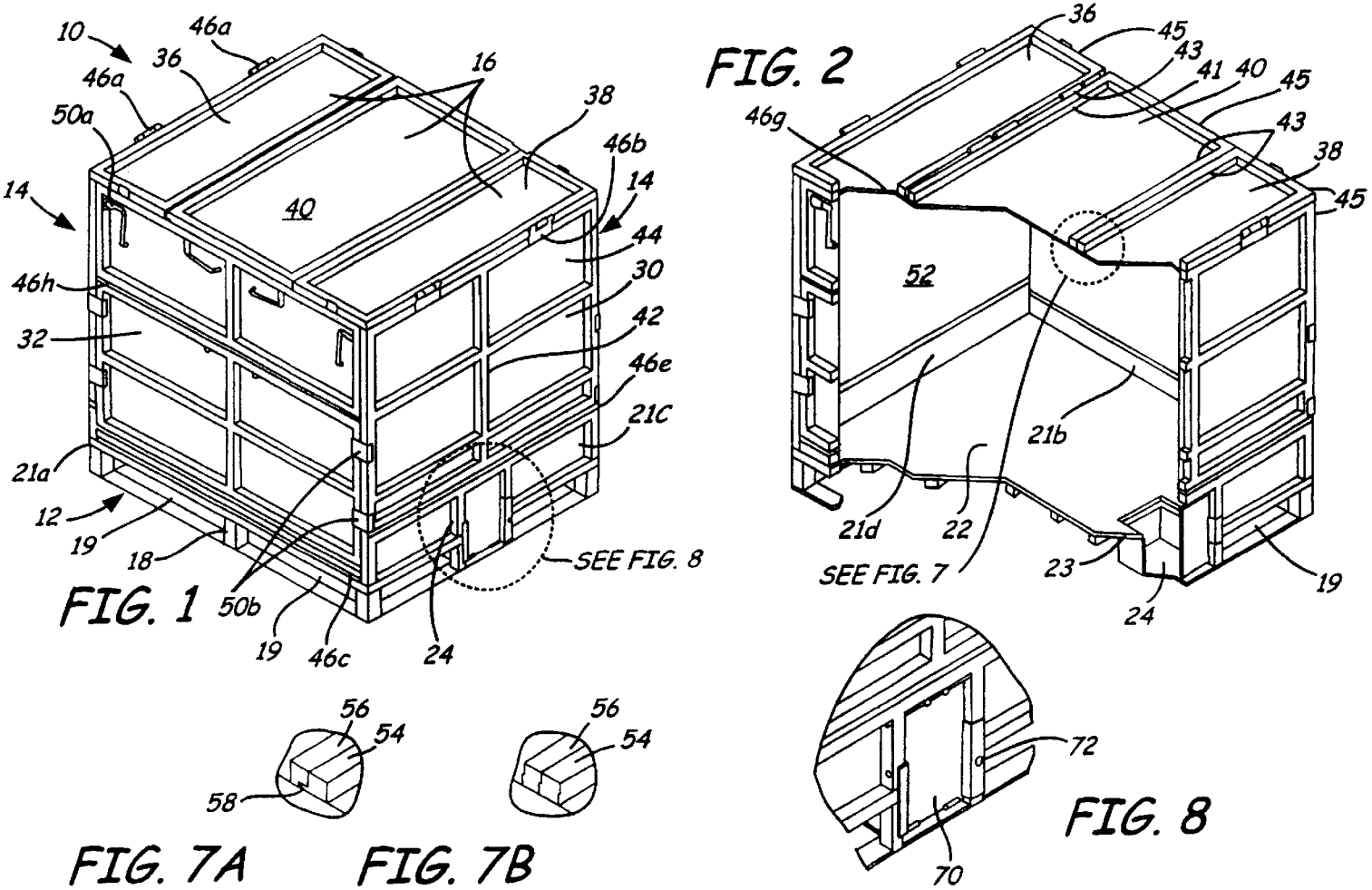
FIG. 1 is an isometric view of an IBC embodiment in its erected configuration.
FIG. 2 is a fragmentary isometric view of the IBC embodiment in FIG. 1.
FIG. 7A is a detailed isometric view of one embodiment of the joint between the second and third lid sections, having an automatic secure or locking feature.
FIG. 7B is a detailed isometric view of another embodiment of the joint between the second and third lid sections.
FIG. 8 is an enlarged isometric view of a discharge door, with self-snap open/close and safety lock features.
Figure 3:
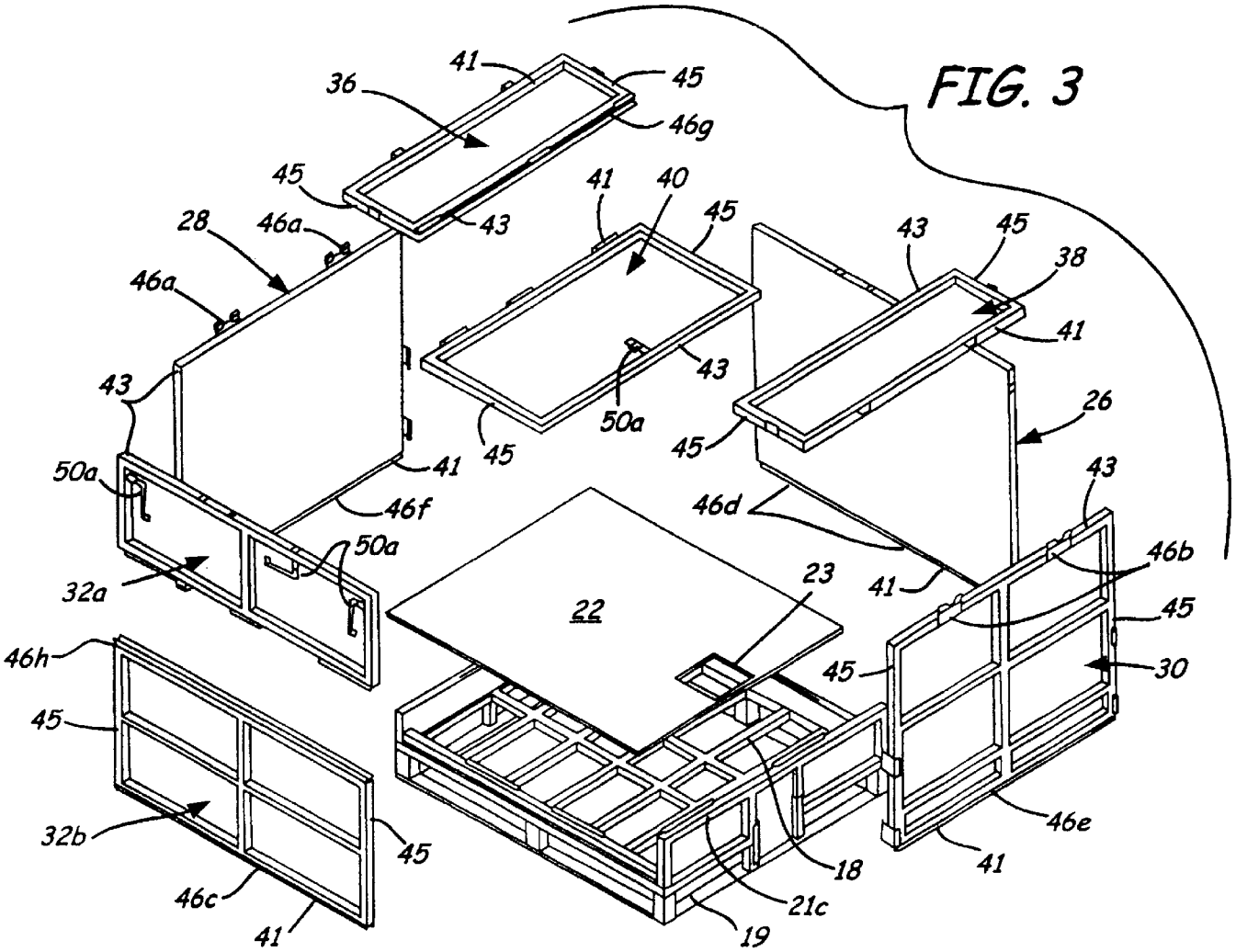
FIG. 3 is an exploded isometric view of the IBC embodiment in FIG. 1.

FIGS. 1–3 show one collapsible intermediate bulk container ("IBC") embodiment 10 in an erected or assembled configuration. This IBC embodiment 10 comprises a generally rectangular base assembly 12, four generally vertical walls 14, and a lid 16. The base assembly 12 comprises an integrated pallet 18 having a plurality of forklift openings 19 and four raised sides 21*a*–21*d* of uneven height, a generally flat base plate 22 having a drain cutout 23 near one edge, and a drain box 24. The four walls 14 comprise a back wall panel 26, a left wall panel 28, a right wall panel 30, and a front wall panel 32. The lid 16 comprises a first lid section 36 pivotally connected to the left wall panel 28, a second lid section 38 pivotally connected to the right wall panel 30, and a third lid section 40 pivotally connected to the first lid section 36. Each panel making up the walls 14 and the lid 16 comprises a generally rectangular frame 42 and a thin rectangular plate 44. Each generally rectangular frame 42, in turn, comprises a hinged edge 41, a free edge 43 that is generally parallel to the hinged edge 41, and a pair of side edges 45 that are generally perpendicular to both the hinged edge 41 and the frame edge 43. The base assembly 12, the walls 14, and the lid 16 cooperate to form a container cavity 52 when the IBC 10 is in its erected or assembled configuration.

The IBC 10 embodiment in FIGS. 1–3 also includes plurality of hinges 46*a*–46*g* that pivotally connect the base assembly 12, the wall panels 14, and the lid 16 to one another; and a plurality of panel locks 50 that lock adjacent wall panels 14 to one another, thereby holding the IBC 10 in its erected or assembled configuration. Specifically, the hinges 46*a* pivotally connect the left wall panel to the first lid section 36, the hinges 46*b* pivotally connect the right wall panel 30 to the second lid section 38, the hinges 46*c* pivotally connect the front wall panel 32 to the base assembly 12, the hinges 46*d* pivotally connect the back wall panel 26 to the base assembly 12, the hinges 46*e* pivotally connect the right wall panel 30 to the base assembly 12, the hinges 46*f* pivotally connect the left wall panel to the base assembly 12, and the hinges 46*g* pivotally connect the first lid section 36 to the second lid section 40. The panel locks 50 in this embodiment comprise a plurality of sliding bolts 50*a* and a plurality of self grab brackets 50*b*. The sliding bolts 50*a* are attached to the front wall 32, back wall 26, and third lid 40 panels and can be slid into corresponding holes in the left wall 28, right wall 30, and third lid 40 panels. The self grab brackets 50*b* are attached to the left wall panel 28 and the right wall panel 30, and engage the frame 42 portion of the front wall panel 32 and the back wall panel 26. When engaged, the sliding bolts 50*a* and the self grab brackets 50*b* securely hold the IBC 10 in its erected or assembled position.

Figure 4:
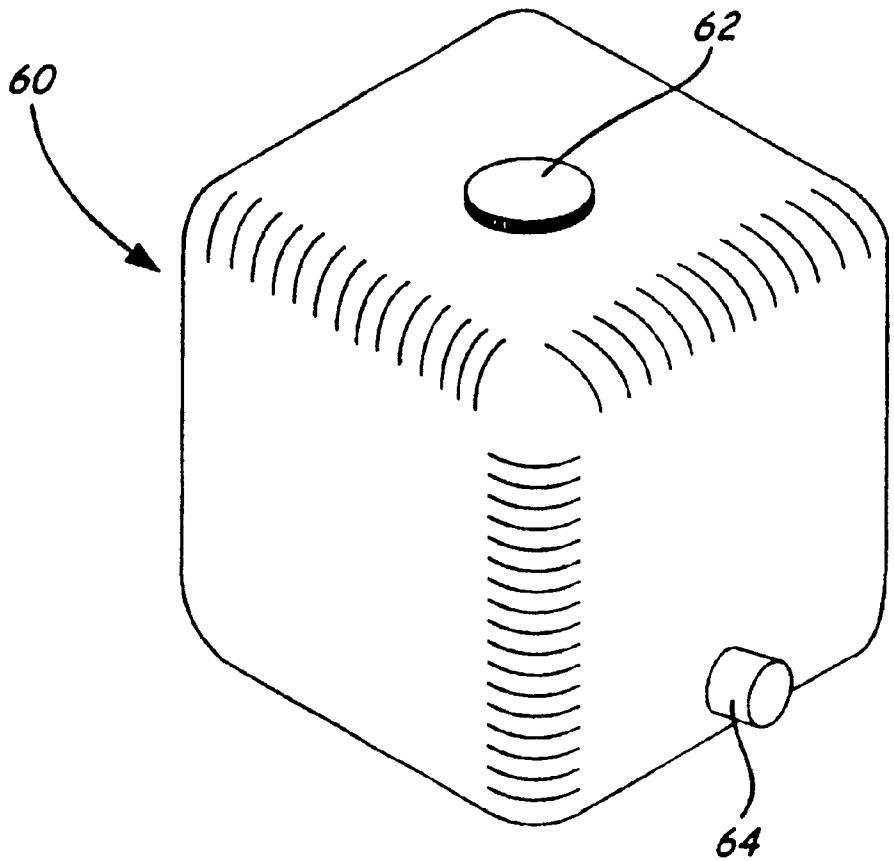
FIG. 4 is an isometric view of a removable liner suitable for use with the IBC in FIG. 1.

The IBC 10 may be provided with a removable liner 60 that receives and stores the IBC's contents. FIG. 4 shows one removable liner 60 embodiment that is made from a flexible plastic material, such as high or low density polyethylene. This liner 60 has a fill port 62 and a drain valve 64 that may be used for filling, sampling, or emptying the container's contents. The fill port 62 is centrally located on the side of the liner 60 which is closest to the lid 16 when the liner 60 is inserted into the cavity 52 and consists of a threaded opening sealed with a screw-in or screw-on cap. The drain valve 64 in this embodiment is located near one edge of the liner's 60 lowermost side (i.e., closest to the base assembly 12) and may comprise any device capable of selectively dispensing the IBC's contents. Other liner 60 embodiments capable of holding the IBC's contents are also within the scope of the present invention. This specifically includes, without being limited to, rigid bottles and flexible bottles/liners such as those made from high density polyethylene, low density polyethylene, or other plastic materials.

In operation, the seller first assembles the IBC 10 into the erected configuration shown in FIGS. 1–3 and places the liner 60 into the container cavity 52. The seller then fills the liner 60 with its product through the port 62 and closes the lid 16. Next, the seller ships the filled IBC 10 to its customer. The customer receives the filled IBC 10 from the seller and removes the product from the liner 60 through one of the openings 62 and 64. When the liner 60 is empty, the customer opens the lid 16, removes the liner 60 from the IBC 10, and folds the IBC 10 into the folded configuration shown in FIGS. 6A–6D. The folded IBC 10 can then be stacked and shipped back to the seller.

Figure 5:
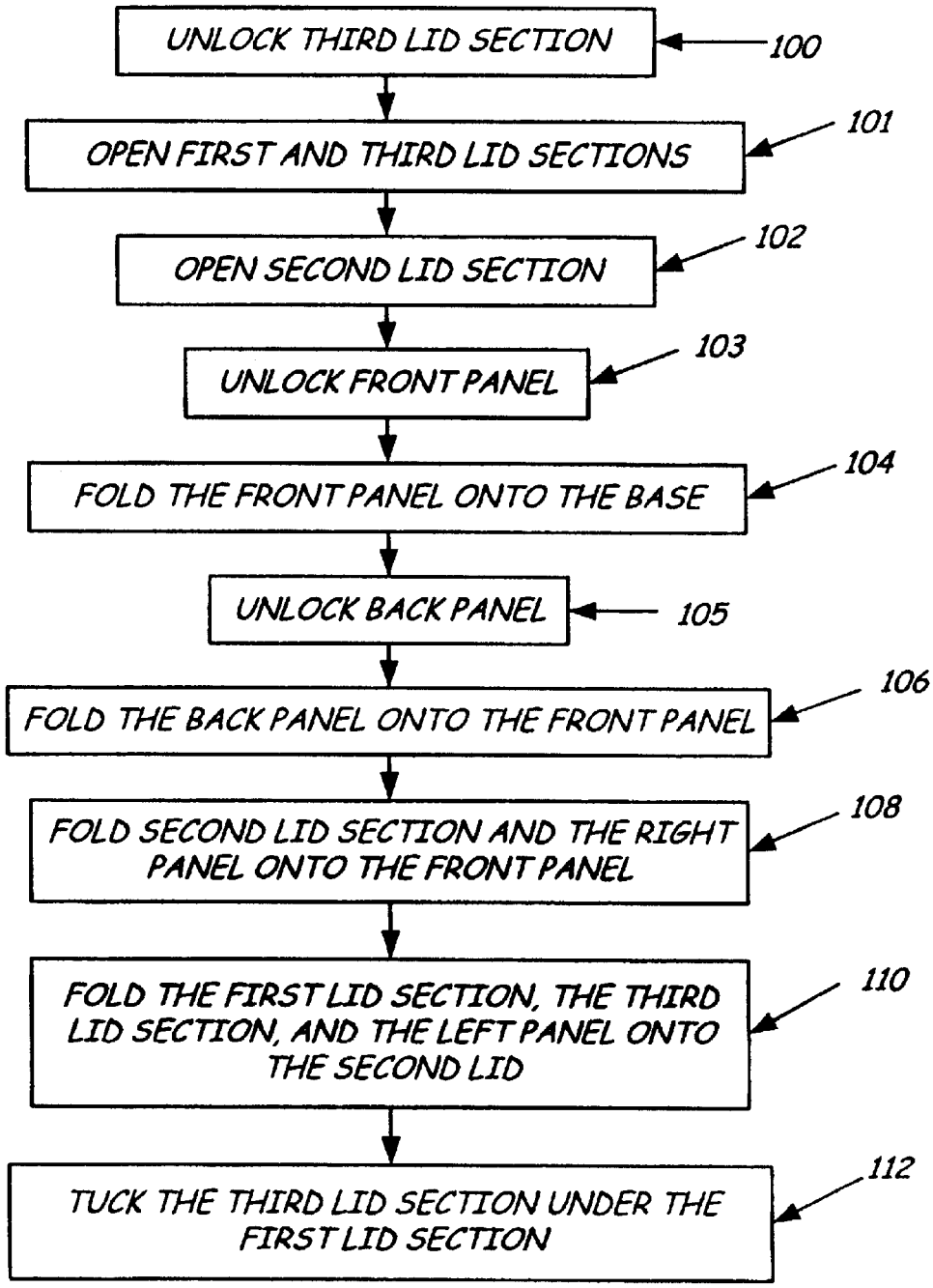
FIG. 5 schematically illustrates the method steps of one method of folding the IBC embodiment in FIG. 1.
Figure 6C:
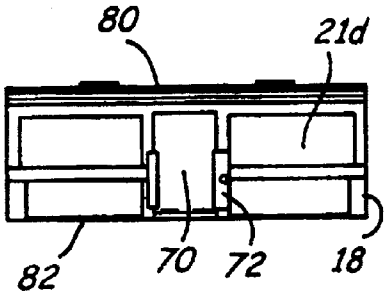
FIGS. 6A–6C are, respectively, elevational left side, front, and right side views of the IBC in its folded configuration.
Figure 6B:
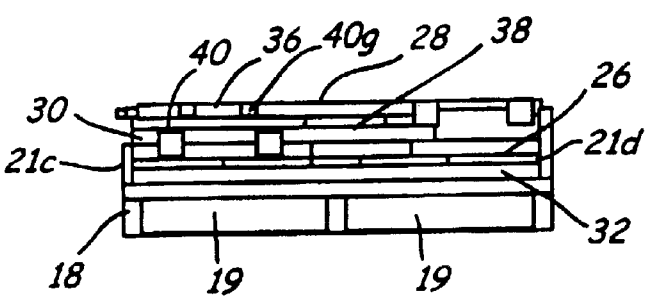
Figure 6A:
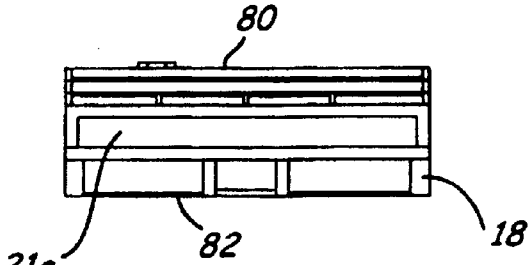
Figure 6D:
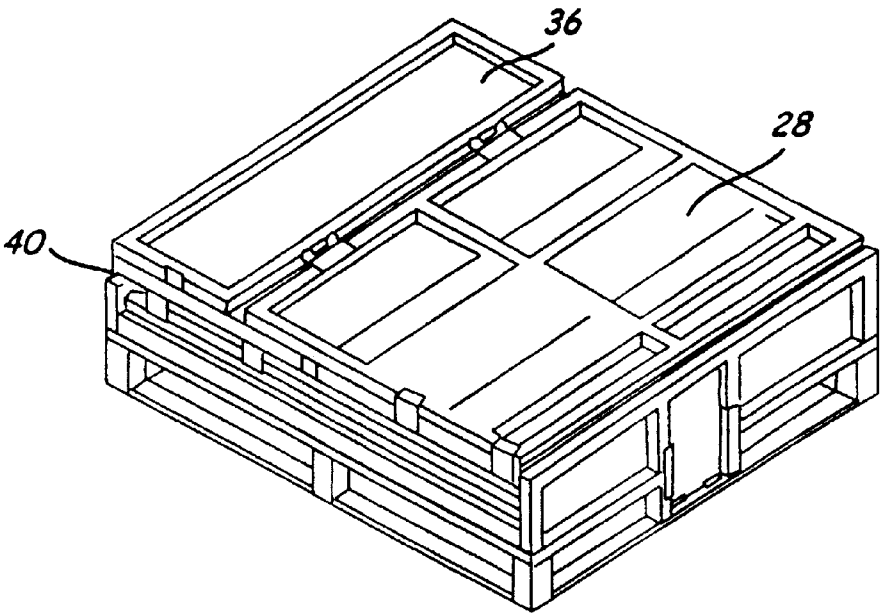
FIG. 6D is an isometric view of the IBC in its folded configuration.

FIG. 5 is a flow chart illustrating one method of converting the IBC 10 from the erected or assembled configuration shown in FIGS. 1–3 to the folded configuration shown in FIGS. 6A–6D. At step 100, the panel locks 50 connecting the third lid section 40 to the front wall panel 32, the back wall panel 26, and the second lid section 38 are unlatched. At step 101, the first and third lid sections 36 and 40 are pivoted outwardly around the hinge 46*a* until their outer surfaces hang vertically, adjacent to the outer surface of the left wall panel 28. At step 102, the second lid section 38 is pivoted outwardly around the hinge 46*b* until its outer surface hangs vertically, adjacent to the outer surface of the right wall panel 30. At step 103, the panel locks 50 that connect the front wall panel 32 to the left wall panel 28 and the right wall panel 30 are unlatched. At step 104, the front wall panel 32 is pivoted inwardly around hinge 46*c* until its inner surface lies flat on top of and adjacent to the top surface of the base assembly 12. At step 105, the panel locks 50 that connect the back wall panel 26 to the left wall panel 28 and the right wall panel 30 are unlatched. At step 106, the back wall panel 26 is pivoted inwardly around the hinge 46*d* until its inner surface lies flat on top of and adjacent to the outer surface of the front wall panel 32. At step 108, the right wall panel 30 (with the connected second lid section 38) is pivoted inwardly around the hinge 46*e* until the inner surface of the right wall panel 30 lies flat on top of and adjacent to the outer surface of the back wall panel 26. In this configuration, the outer surface of the second lid section 38 lies flat on top of and adjacent to the outer surface of the right wall panel 30. At step 110, the left wall panel 28 (with the connected first lid section 36 and third lid section 40) is pivoted inwardly around the hinge 46*f* until the inner surface of the left wall panel 20 lies on top of and adjacent to the inner surface of the second lid section 38. Finally, at step 112, the third lid section 40 is pivoted inwardly 360 degrees around the hinge 46*g* and tucked under the first lid section 36. Accordingly, steps 100–112 result in a folded IBC 10 having a top surface 80 that is parallel with its bottom surface 82 (i.e., a "flat top").

To assemble the container from the folded position shown in FIGS. 6A–6D, the above mentioned steps are reversed. Specifically, the first lid section 36 and the third lid section 40 are first pivoted outwardly around hinge 46*g* and laid flat on top of the left wall panel 28. Second, the left wall panel 28 (with the connected first lid section 36 and third lid section 40) and the right wall panel 30 (with the connected second lid section 38) are pivoted outwardly around hinges 46*f* and 46*e*, respectively, into generally vertical positions. Third, the back wall panel 26 is pivoted outwardly around hinge 46*d* into a generally vertical position and locked to the left and right panels 28 and 30 with the panel locks 50. Fourth, the front wall panel 32 is pivoted outwardly around hinge 46*c* into a generally vertical position and locked to the left and right panels 28 and 30 with the panel locks 50. Fifth, the lid sections 36, 38, and 40 are pivoted inwardly around the hinges 46*a*–46*c* onto the top edges of the walls 14. In this configuration, the lid sections 36, 38, and 40 cooperate to form a flat, generally horizontal surface that completely covers the cavity 52. Finally, the third lid section 40 is locked to the front wall panel 32, the back wall panel 26, and the second lid section 38 with the panel locks 50.

Referring again to FIGS. 1–3, the integrated pallet 18 may be any structure capable of supporting the weight at least one IBC 10 and its contents. It is desirable, however, that the integrated pallet 18 be capable of supporting the weight of several stacked IBCs 10 and that the integrated pallet 18 have openings 19 capable of receiving the forks of a forklift (not shown). One suitable integrated pallet comprises a rectangular grid made from steel bar stock. However, pallets 18 having different configurations and made from other materials are within the scope of the present invention. This specifically includes, without being limited to, integrated pallets 18 made from low carbon steel, galvanized steel, aluminum, wood, or plastic.

The integrated pallet in this embodiment has four raised sides 21*a*–21*d*. It is desirable that each of the four raised sides 21*a*–21*d* have a different height and be generally parallel with the base assembly 12 so that the walls 14 will lay flat when the IBC 10 is in its folded configuration. For this reason, side 21*b* is higher than side 21*a* by about the thickness of the front wall panel 32, side 21*c* is higher than side 21*b* by about the thickness of the back wall panel 26, and side 21*d* is higher than side 21*c* by about the combined thickness of the right wall panel 30 and the second lid section 38. Preferably, the height of each wall panel varies so that, in the erected state, the total heights of each side 21*a*–21*d* plus the height of its corresponding wall 14 are substantially identical.

The integrated pallet 18 in this embodiment is covered with a flat base plate 22. This base plate 22 can be made from any material that is strong enough to support the combined weight of the liner 60 and its contents. It is desirable, however, that the base plate 22 be made from a smooth, relatively lightweight, and corrosion resistant material, such as plastic, wood, aluminum, low carbon steel, or galvanized steel.

The panels that make up the walls 14 and the lid 16 in this embodiment each comprise a frame 42 and a plate 44. The frame 42 may have any configuration and may be formed from any materials capable of supporting the hydrostatic pressure exerted by the contents of the liner 60. It is desirable, however, that the frame 42 also be strong enough so that it can also support the weight of three or four additional IBC's 10 and their contents. Suitable frames 42 include, without being limited to, a generally rectangular frame made from aluminum, low carbon steel, galvanized steel, plastic, or wood. The plate 44 also may be made from any material capable of resisting the hydrostatic pressure and may be attached to the frame 42 using any means that is compatible with the chosen materials. Suitable materials for the plate 44 include plastics, aluminum, wood, low carbon steel, and galvanized steel. Suitable attachment means include mechanical fasteners, adhesives, and welds.

FIGS. 7A and 7B are detailed views of alternate joints between the second 38 and third 40 lid sections. The joint in FIG. 7A comprises two interlocking members 54 and 56. The member 54 has a shelf 58 that engages the member 56 when both members are parallel to each other, which allows the third lid section 40 to self-lock the second lid section 38 in a closed orientation during transit. That is, closing and locking the third lid section 40 to the side walls automatically locks the first lid section 36 and the second lid section 38. The joint in FIG. 7B also comprises two members 54 and 56. However, the contact between the members 54 and 56 in FIG. 7B is along a substantially vertical line. Unlike embodiments using the joint in FIG. 7A, embodiments using the joint in FIG. 7B will need a separate means to lock the second lid section 38 closed during transit. Those skilled in the art will recognize that other joint embodiments are within the scope of the present invention.

FIG. 8 is a detailed view of one drain box 24 embodiment. In operation, the supplier places the drain valve 64 into the drain box 24 through the cutout 23 in the base plate 22 (see FIG. 2). This configuration is desirable because it allows customers to completely empty the liner 60. In some embodiments, a hinged door 70 protects the drain valve 64 during transit and provides the customer with easy access to the valve 64. This hinged door 70 may be locked into place using any suitable means, such as a bolt or latch. A magnetic latch 72 may be particularly desirable for use with steel pallets 18 because the customer will not need special tools to open the door 70. Despite these advantages, however, embodiments without the door 70, the latch 72, and/or the drain box 24 are within the scope of the present invention.

The hinges 46*a*–46*f* may be any devices that provide the appropriate degree of pivotal motion. In the embodiments depicted in FIGS. 1–3, the hinges 46*a*–46*b* used to connect the lid 16 to the walls 14 can be any hinge device with an approximate 270-degree operating range. The hinges 46*c*–46*f* in these embodiments should be "stop" hinges having an approximate 90-degree operating range. These embodiments are desirable because the stop hinges permit the walls 14 to be pivoted inwardly onto the base 12, but not outwardly past their perpendicular position. That is, each wall 14 may be pivoted to a substantially perpendicular position in relation to the base 12 during erection and left unattended without the danger of it falling outwardly. This feature may ease the erection of the IBC 10. Hinges having the described features and operating ranges are well-known and widely available. This specifically includes, without being limited to, butt hinges, strap hinges, tee hinges, continuous hinges, non-continuous hinges, fabric hinges, and living hinges.

Figure 12:
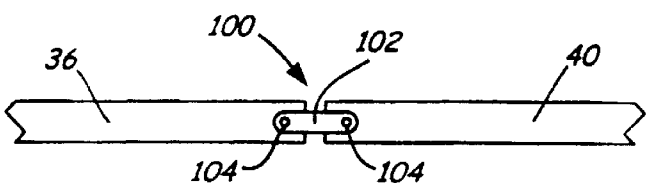
FIG. 12 is an plan view of a universal hinge embodiment.

The hinge 46*g* used to connect the first 36 and third 40 lid sections in FIGS. 1–3 can be any device that provides an approximate 360-degree operating range, such as the universal hinge 100 embodiment shown in FIG. 12. This universal hinge 100 embodiment comprises a linking member 102 that is connected to each lid section by a pin 104. The linking member 102 should be long enough so that the first lid section 36 and the third lid section 40 do not interfere with each other when rotated through their operating range. Other 360 degree hinge devices are also within the present invention.

Figure 15:
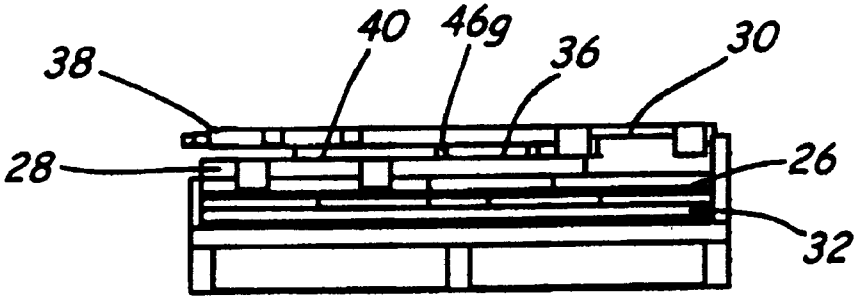
FIG. 15 is a front plan view of an alternate IBC embodiment in its folded configuration.

Further, although the hinge 46*g* in the embodiment shown FIGS. 1–3 provides about 360 degrees of motion, it is contemplated that the benefits of the present invention may also be achieved with a hinge 46*g* that provides fewer degrees of motion. FIG. 15 shows one such embodiment in which the hinge 46*g* connecting the first lid section 36 and the third lid section 40 is a 180 degree hinge. In this embodiment, the left wall panel 28, the first lid section 36, and third lid section 40 are folded onto the base assembly 12 before the right wall panel 30 and second lid section 38. Accordingly, acts 106–112 in FIG. 5 should be modified so that the left wall panel 28 (with the connected first lid section 36 and third lid section 40) is first pivoted inwardly around the hinge 46*f* until the inner surface of the left wall panel 28 lies flat on top of and adjacent to the outer surface of the back wall panel 26. In this configuration, the outer surface of the first lid section 36 and the outer surface of the third lid section 40 lie flat on top of and adjacent to the outer surface of the left wall panel 28. Next, the right wall panel 30 (with the connected second lid section 38) is pivoted inwardly around the hinge 46*e* until the inner surface of the right wall panel 30 and the inner surface of the second lid section 38 lie on top of and adjacent to the inner surface of the first lid section 36 and the inner surface of the third lid section 40. Those skilled in the art will recognize that the raised sides 21*a*–21*d* should also be appropriately modified so that the heights of the walls 14 are equal when the IBC 10 is in its erected configuration and so that the IBC 10 will have a flat top surface 80 in its folded configuration.

Referring again to FIGS. 1–3, the IBC 10 incorporates a plurality of panel locks 50 that secure the walls 14 and the lid 16 together while the IBC 10 is in its erected position. In one embodiment, the panel locks 50 comprise a combination of sliding bolts 50*a* and self-grab brackets 50*b*. Embodiments using sliding bolts 50*a* and self grab brackets 50*b* are desirable because they sit inside the panel frames 42 when the IBC 10 is in its folded configuration. Despite these advantages, however, other panel locks 50 are within the scope of the present invention. This specifically includes, without being limited to, catches, latches, clips, levers, hooks, clamps, and brackets.

Figure 13:
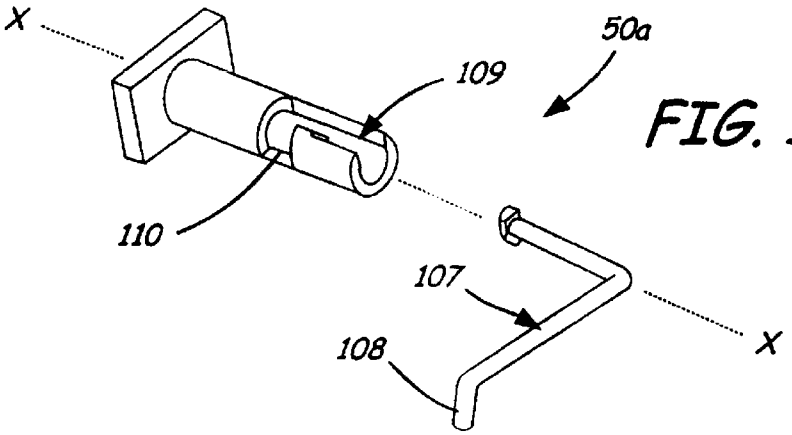
FIG. 13 is an exploded isometric view of a sliding bolt embodiment.

FIG. 13 shows one sliding bolt 50*a* embodiment suitable for use with the IBC 10 in FIGS. 1–3. This sliding bolt 50*a* embodiment comprises a cylindrical body 107, a cam 108, a receiving cavity or guided slot 109, and a shelf or notch 110. The cam 108 selectively engages and disengages the shelf 110 when the cylindrical body 107 is inserted into the cavity 109 and rotated around axis X. Other sliding bolt 50*a* embodiments are also within the scope of the present invention.

Figure 14B:
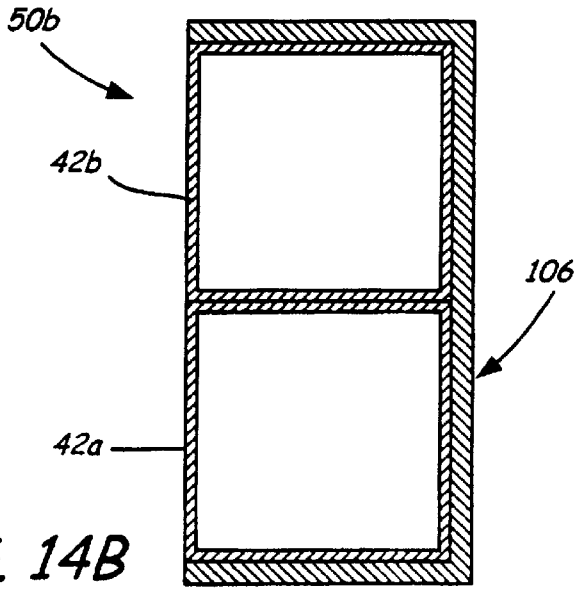
FIGS. 14A and 14B are sectional views of a self-grab bracket embodiment
Figure 14A:
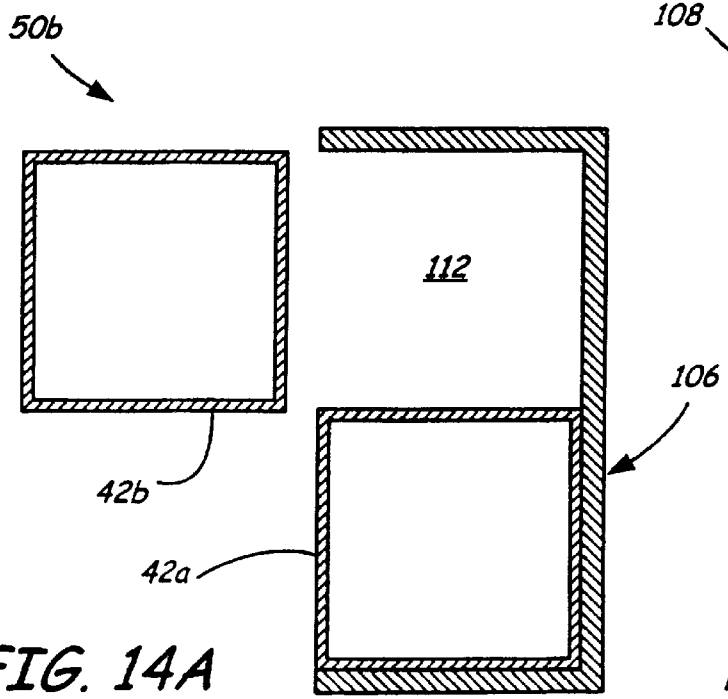

FIGS. 14A and 14B are sectional views of one self-grab bracket 50*b* embodiment suitable for use with the IBC 10 in FIGS. 1–3. Specifically, FIG. 14A shows the self-grab bracket 50*b* at a point in time just before the walls 14 are unfolded into their erected configuration. FIG. 14B shows the self-grab bracket 50*b* at a point in time just after the walls 14 are unfolded into their erected configuration. The self-grab bracket 50*b* in FIG. 14A and 14B comprises a U-shaped member 106 that is permanently attached to one frame member 42*a*. This U-shaped member 106 has a receiving channel 112 that selectively receives a second frame member 42*b* as the IBC 10 is unfolded into erected configuration. The U-shaped member 106 releaseably holds the first frame member 42*a* and the second frame member 42*b* from moving relative to each other.

Figure 9:
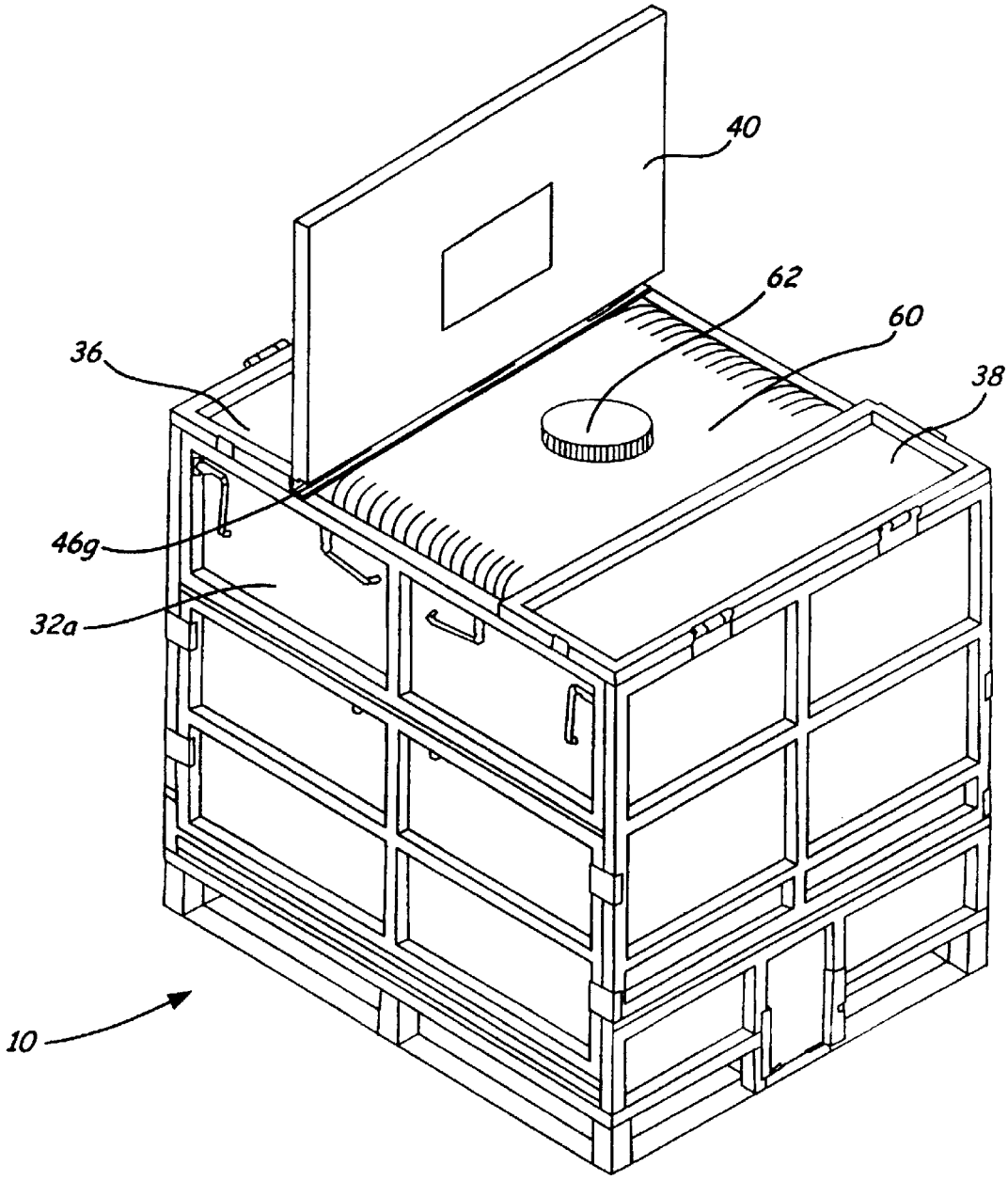
FIG. 9 is an isometric view of the IBC with its lid in a partially open configuration.

FIG. 9 depicts the IBC 10 in FIGS. 1–3 with its third lid section 40 in a partially open configuration. This figure shows that pivoting the third lid section 40 outwardly around the hinge 46*g* exposes the fill port 62. Thus, the third lid section 40 allows the user to access the fill port 62 without having to open the entire lid 16. Because the third lid section 40 is smaller than the lid 16, it requires less clearance to open. For this reason, it is desirable that the third lid section 40 cover less than about one-half of the total lid 16. Third lid sections 40 having a width between about twenty and forty percent of the total lid 12 are particularly desirable. However, embodiments in which the third lid section 40 covers more than about one-half of the total lid 12 are also within the scope of the present invention.

Figure 10:
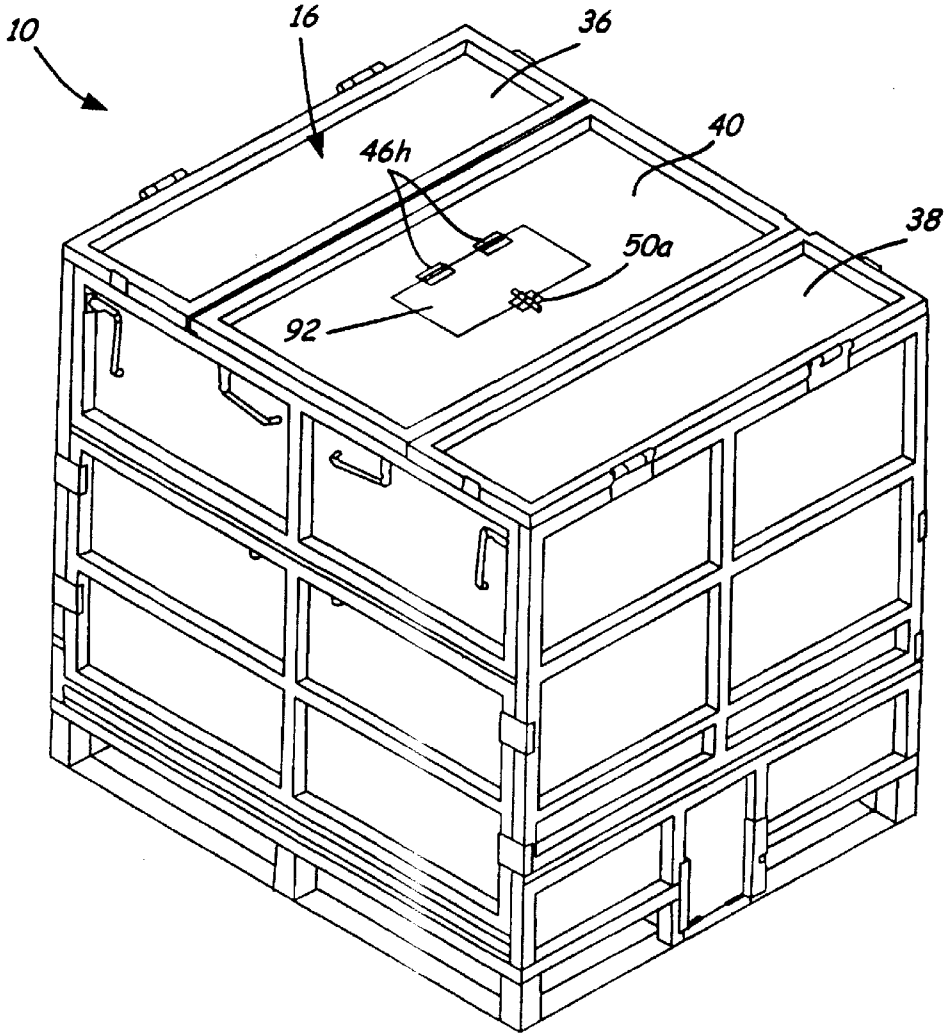
FIG. 10 is an isometric view of an IBC embodiments having a door that provides access to the liner's fill port.

FIG. 10 shows an alternate IBC 10 embodiment in which the lid 16 has an access door 90 that is pivotally connected to the third lid section 40 by a hinge 46*h*. This hinged access door 90 should be sized and positioned to provide easy access to the fill port 62. Embodiments with this access door 90 are desirable because they provide a second means of accessing the fill port 62 without having to open the entire lid 16. That is, some users require a six-inch opening to insert the equipment necessary to handle viscous materials. Others users only require a two-inch opening, thus the access door 90.

Figure 11:
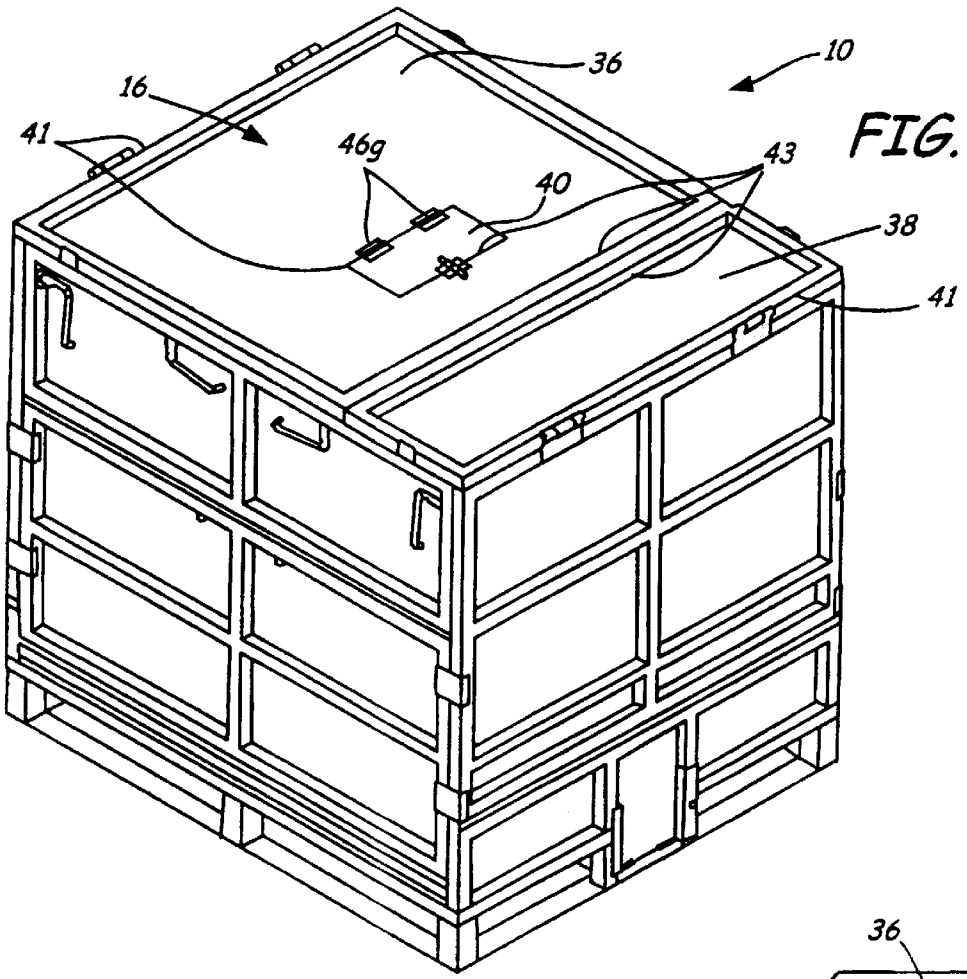
FIG. 11 is an isometric view of an IBC embodiment in which one lid section has a length less than one half of the container's length and a width less than one half of the container's width.

FIG. 11 shows an IBC 10 embodiment in which the third lid section 40 is internally connected to an enlarged first lid section 36. That is, the third section 40 is connected to this enlarged first section 36 somewhere between its hinged edge 41 and its free edge 43. Like the hinged door 90 in FIG. 10, the third lid section 40 in FIG. 11 should be sized and positioned to provide access to the fill port 62 when pivoted outwardly around hinge 46*g*. Thus, depending on the relative sizes of the first lid section 36 and the third lid section 40, the first lid section 36 may completely surround (i.e., "frame") the third lid section 40 or may be "notched" such that its free edge 43 is collinear with the free edge 43 of the third lid section 40. As depicted in FIG. 11, the first lid section 36 in these embodiments may cover more than about one-half of the cavity 52.

The IBC 10 in some embodiments of the present invention is about 1.2 meters×1.0 meters×1.15 meters in its erected configuration and about 1.2 meters×1.0 meters×0.36 meters in its folded configuration. Embodiments having these dimensions are desirable because they allow for efficient shipment in standard ISO shipping containers. However, other sizes and shapes are within the scope of the present invention.

Although the present invention has been described in detail with reference to certain embodiments thereof, it may be embodied in other specific forms without departing from the essential spirit or attributes thereof. For example, the walls 14, the base assembly 12, and the lid 16 could each comprise a single pieces of plastic that has been molded or cast into the appropriate shapes. These embodiments may be desirable because they would require fewer parts and because they would be relatively lightweight. The base assembly 14 may also have a tapered floor in some embodiments that helps direct the IBC's contents into the drain valve 64. In addition, the front wall panel 32 may be split into two sections 32*a* and 32*b* that are connected together by a hinge 46*h*. Embodiments having a split front wall panel 32 may be desirable because users can more easily insert the liner 60 into the cavity 52 when the IBC 10 is in its erected configuration.

The present invention offers many advantages over conventional shipping containers. For example, the third lid section 40 allows users to access the fill port 62 without having to open the entire lid 16. This feature can be a particular advantage when the IBC 10 is used in confined areas. In addition, the present invention has parallel top and bottom surfaces when in its erected configuration and in its folded configuration. This feature is desirable because it allows users to stack the containers. Also, the present invention is compatible with the center-fill equipment typically used to fill rigid plastic bottles.

Those skilled in the art will recognize that the accompanying figures and this description depicted and described embodiments of the present invention, and features and components thereof. With regard to means for fastening, mounting, attaching or connecting the components of the present invention to form the mechanism as a whole, unless specifically described otherwise, such means were intended to encompass conventional fasteners such as machine screws, nut and bolt connectors, machine threaded connectors, snap rings, screw clamps, rivets, nuts and bolts, toggles, pins and the like. Components may also be connected by welding, friction fitting, adhesives, or deformation, if appropriate. Unless specifically otherwise disclosed or taught, materials for making components of the present invention were selected from appropriate materials, such as metal, metallic alloys, fibers, polymers and the like, and appropriate manufacturing or production methods including casting, extruding, molding and machining may be used. In addition, any references to front and back, right and left, top and bottom and upper and lower were intended for convenience of description, not to limit the present invention or its components to any one positional or special orientation. Therefore, it is desired that the embodiments described herein be considered in all respects as illustrative, not restrictive, and that reference be made to the appended claims for determining the scope of the invention.

What is claimed is:

1. A collapsible shipping container, being convertible into a folded position for storage and into an assembled position for use, said container comprising:

a generally rectangular base;

a first side wall, a second side wall, a third side wall and a fourth side wall, each side wall pivotally connected to the base wherein each side wall pivots between a generally perpendicular and a generally parallel position relative to the base;

a first lid section pivotally connected to the first side wall;

a second lid section pivotally connected to the second side wall; and a third lid section outwardly pivotally connected to the first lid section, each of said first lid section, said second lid section and said third lid section lying substantially in a common plane when the shipping container is in its assembled position.

2. The shipping container of claim 1, wherein each of the side walls is connected to the base by a hinge.

3. The shipping container of claim 2, wherein the third side wall comprises a lower panel pivotally connected to the base and an upper panel pivotally connected to the lower panel.

4. The shipping container of claim 1, further comprising a lock adapted to selectively hold the first side wall in a substantially vertical position.

5. The shipping container of claim 1, wherein the base comprises a forklift opening.

6. The shipping container of claim 1, wherein the base comprises a drain box.

7. The shipping container of claim 1, further comprising a liner adapted to be received inside the shipping container.

8. The shipping container of claim 7, wherein the liner comprises a fill port and a drain valve.

9. The shipping container of claim 8, further comprising a discharge door adapted to provide access to the drain valve.

10. The shipping container of claim 1, wherein the third lid section covers less than about one-half of the shipping container.

11. The shipping container of claim 1, wherein the first lid section and the third lid section are connected by a universal hinge.

12. The shipping container of claim 1, wherein the third lid section has a length less than one half of the shipping container's length and a width less than one half of the shipping container's width.

13. The shipping container of claim 1, further comprising a latch adapted to releaseably hold the third lid section in a closed position.

14. The shipping container of claim 13, wherein the latch is a sliding bolt.

15. A collapsible shipping container, being convertible into a folded position for storage and into an assembled position for use, said container comprising:

(a) a generally rectangular base;

(b) at least four walls pivotally connected to the base, wherein the at least four walls and the base cooperate to form a cavity when the shipping container is in its assembled position;

(c) a removable liner adapted for insertion into the cavity, the removable liner having a fill port;

(d) a first lid section pivotally connected to a first wall of the at least four walls;

(e) a second lid section pivotally connected to a second wall of the at least four walls; and (f) a third lid section pivotally connected to the first lid section, said third lid section being outwardly pivotally connected to said first lid section when the container is in its assembled position, the third lid section in filling alignment with the fill port and covering less than about one-half of the cavity, each of said first lid section, said second lid section and said third lid section lying substantially in a common plane when the shipping container is in its assembled position.

16. A method of collapsing a shipping container having a first lid section pivotally connected to a first side wall, a second lid section pivotally connected to a second side wall, and a third lid section pivotally connected to the second lid section, the method comprising:

(a) pivoting the first side wall and the first lid section from a generally vertical configuration to a generally horizontal configuration, whereby an outer surface of the first lid section lies adjacent to an outer surface of the first side wall; and (b) pivoting the second side wall, the second lid section, and the third lid section from a generally vertical configuration to a generally horizontal configuration, whereby an inner surface of the second lid section lies adjacent to an inner surface of the third lid section and whereby an outer surface of the third lid section lies adjacent an inner surface of the first lid.

* * * * *